US006658226B2

(12) United States Patent
Wang et al.

(10) Patent No.: US 6,658,226 B2
(45) **Date of Patent: *Dec. 2, 2003**

(54) PROCESS CARTRIDGE TONER SUPPLY ARRANGEMENT FOR IMAGE FORMING APPARATUS

(75) Inventors: Jui-Chi Wang, Taichung (TW); Robin Hsu, Taichung (TW); Ya Li Huang, Taichung (TW); Kuan Tung Li, Yunlin (TW); Shu Hui Wang, Taichung (TW); Smarla Hui Wang, Taichung (TW); Ting-Hsuan Ko, Taichung (TW); Renhao Liu, Taichung (TW); Hui-Wen Hsieh, Taichung (TW)

(73) Assignee: General Plastic Industrial Co., Ltd. (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/171,039

(22) Filed: Jun. 11, 2002

(65) Prior Publication Data

US 2003/0185597 A1 Oct. 2, 2003

(30) Foreign Application Priority Data

Feb. 8, 2002 (TW) ..... 091201947 U

(51) Int. Cl.[7] ..... G03G 15/08
(52) U.S. Cl. ..... 399/258; 399/260

(58) Field of Search ..... 399/258, 105, 399/106, 111, 113, 259, 260, 262; 222/DIG. 1; 141/364

(56) References Cited

U.S. PATENT DOCUMENTS

| | | | | | |
|---|---|---|---|---|---|
| 4,456,154 | A | * | 6/1984 | Herriman | 222/DIG. 1 |
| 4,615,364 | A | * | 10/1986 | Kawata | 222/DIG. 1 |
| 5,142,335 | A | * | 8/1992 | Sakata et al. | 399/106 |
| 5,475,469 | A | * | 12/1995 | Okada et al. | 399/264 |
| 6,115,571 | A | * | 9/2000 | Kobayashi | 399/111 |
| 2003/0039484 | A1 | * | 2/2003 | Naito et al. | 399/113 |

FOREIGN PATENT DOCUMENTS

| | | | | |
|---|---|---|---|---|
| JP | 60095464 | * | 5/1985 | G03G/15/08 |

* cited by examiner

*Primary Examiner*—Susan S. Y. Lee
*Assistant Examiner*—Ryan Gleitz
(74) *Attorney, Agent, or Firm*—Merchant & Gould LLC

(57) ABSTRACT

A process cartridge toner supply arrangement used in a laser printer for controlling supply of toner is constructed to include a receiving member, the receiving member having toner receiving openings and a toner accommodating portion, a replaceable supplying member, the supplying member having a toner accommodating portion and toner supplying openings, and a blocking member provided between the receiving member and the supplying member and moved to close/open the toner passage between the toner receiving openings and the toner supplying openings.

14 Claims, 9 Drawing Sheets

PROCESS CARTRIDGE TONER SUPPLY ARRANGEMENT FOR IMAGE FORMING APPARATUS

BACKGROUND OF THE INVENTION

1. Field of the Invention

The present invention relates to a process cartridge and, more particularly, to a process cartridge toner supply arrangement used in a laser printer for controlling the toner passage between the toner container and the developing device.

2. Description of the Related Art

A regular process cartridge for a laser printer is generally comprised of an electrophotographic photosensitive member, developing means, charging means, cleaning means, and a toner container. When the toner container is used up, the whole assemble of the process cartridge becomes useless and must be thrown away. It is not economical to throw the whole assembly of the process cartridge away after the process cartridge is emptied. Further, the waste process cartridge may cause pollution to the environment if it is not disposed of in a proper manner.

SUMMARY OF THE INVENTION

The present invention has been accomplished to eliminate the aforesaid drawbacks. In one aspect, the present invention relates to a sliding cover device arrangement for controlling toner passage between the toner container and the developing device of an image forming apparatus, which enables the user to replace the toner container without throwing the whole assembly of the process cartridge away when the toner of the toner container is depleted. In one embodiment of the present invention, the process cartridge toner supply arrangement comprises a receiving member (developing device), the receiving member comprising a plurality of toner receiving openings and a toner accommodating portion adapted for accommodating toner received from the toner receiving openings, a supplying member (toner container), the supplying member comprising a toner accommodating portion adapted for accommodating toner and a plurality of toner supplying openings adapted for supplying toner from the toner accommodating portion of the supplying member to the toner accommodating portion of the receiving member through the toner supplying openings and the toner receiving openings; and a blocking member provided between the receiving member and the supplying member and moved to close/open the toner passage between the toner receiving openings and the toner supplying openings.

DETAILED DESCRIPTION OF THE PREFERRED EMBODIMENT

Figure 1:
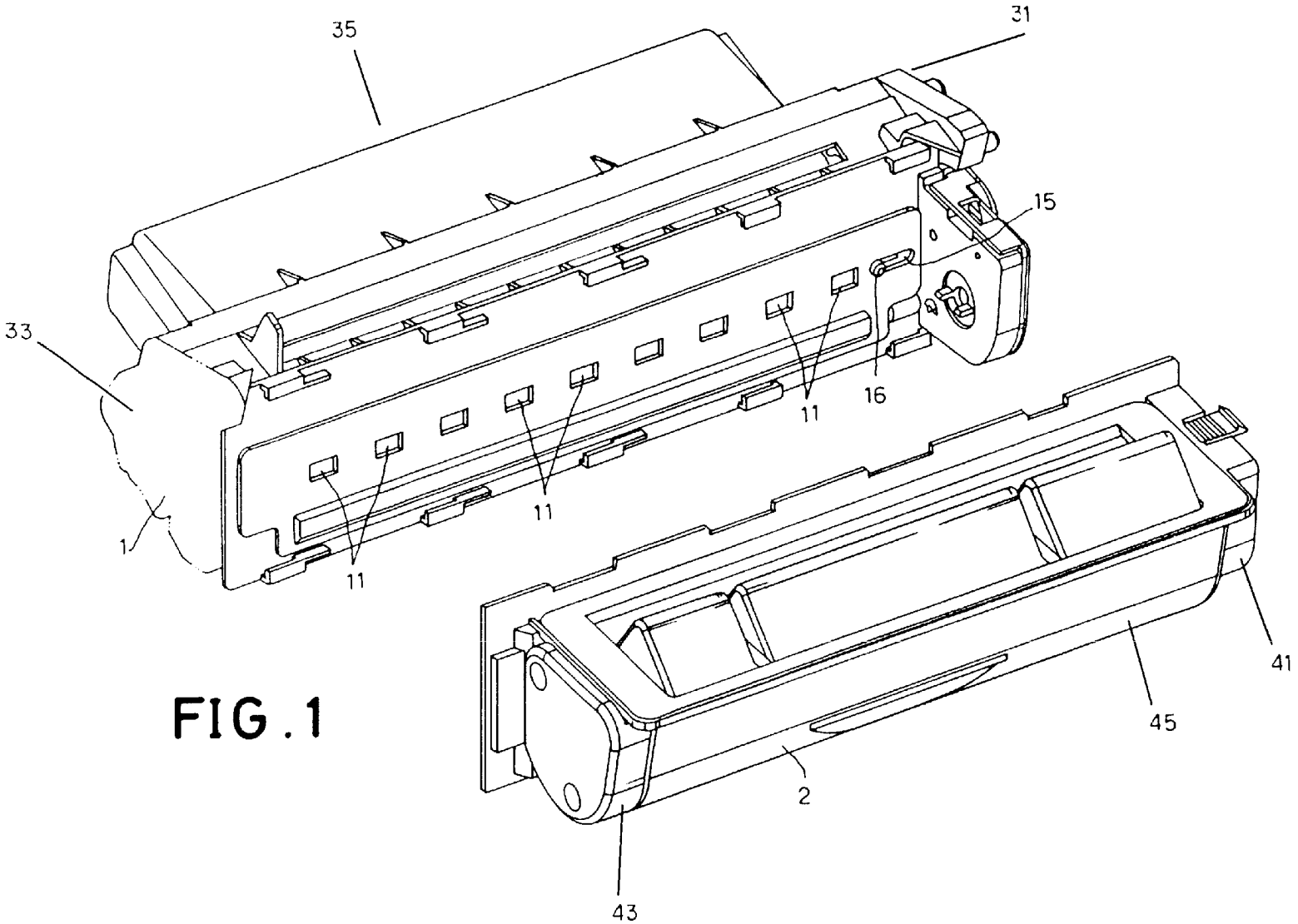
FIG. 1 is an exploded view of the first embodiment of the present invention.
Figure 2:
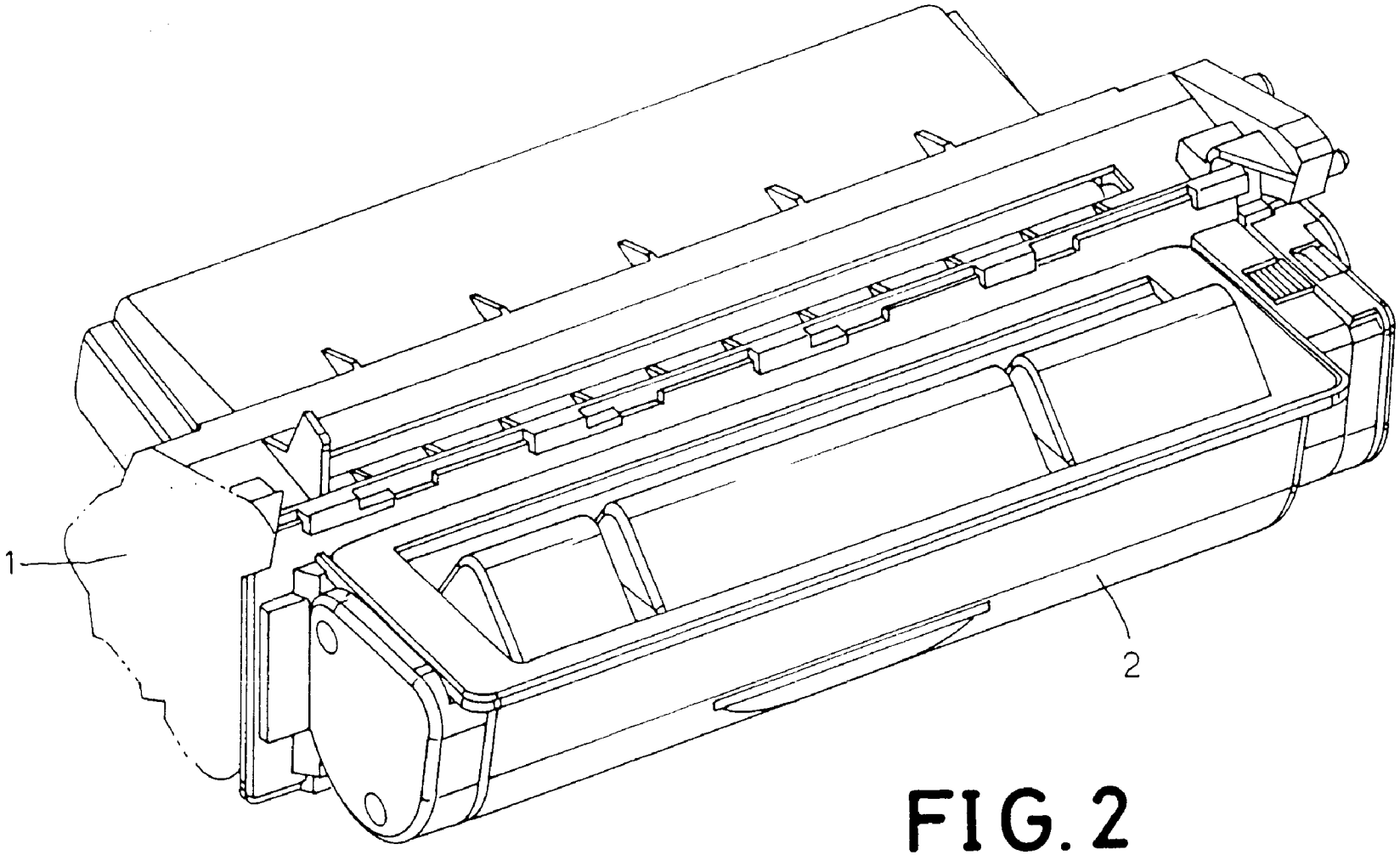
FIG. 2 is an elevational assembly view of the first embodiment of the present invention.

Referring to FIG. 1, a process cartridge toner supply arrangement is shown comprised of a receiving member, a replaceable supplying member, and a blocking member. The receiving member is a developing device 1. The supplying member is a toner container 2. The developing device 1 comprises a first end 31, an opposite second end 33, and a body 35 defined between the first end 31 and the opposite second end 33, wherein the body 35 has a plurality of toner receiving openings 11 arranged in a line on one side thereof, and a toner accommodating portion adapted for accommodating toner. There are electrophotographic photosensitive means, developing means, charging means, and cleaning means provided inside the toner accommodating portion of the developing device 1. Because the internal structure of the developing device 1 is of the known art and not within the scope of the claims of the present invention, no further detailed description on this part is necessary.

Figure 5:
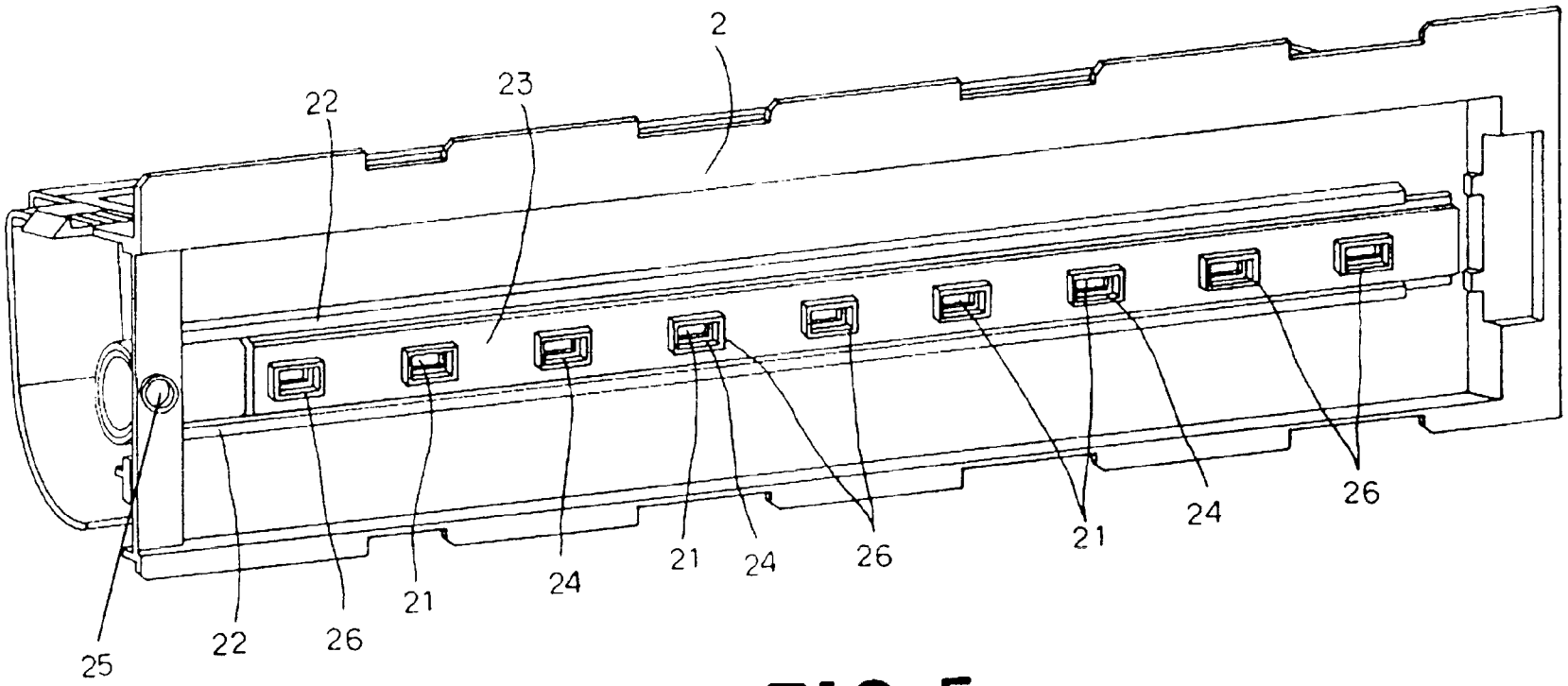
FIG. 5 is a back side view of the toner container, showing the second sliding cover moved to the opening position and the toner supplying openings opened according to the first embodiment of the present invention.

Referring to FIG. 5 and FIG. 1 again, the toner container 2 comprises a first end 41, an opposite second end 43, and a body 45 defined between the first end 41 and the opposite second end 43, wherein the body 45 has an interior surface defining a volume for accommodating toner, and wherein the body 45 has a plurality of toner supplying openings 21 arranged in a line on one side thereof corresponding to the toner receiving openings 11 of the developing device 1 and adapted for guiding toner from the toner accommodating portion defined inside the toner container 2 to the toner accommodating portion of the developing device 1 through the toner supplying openings 21 and the toner receiving openings 11.

Figure 3:
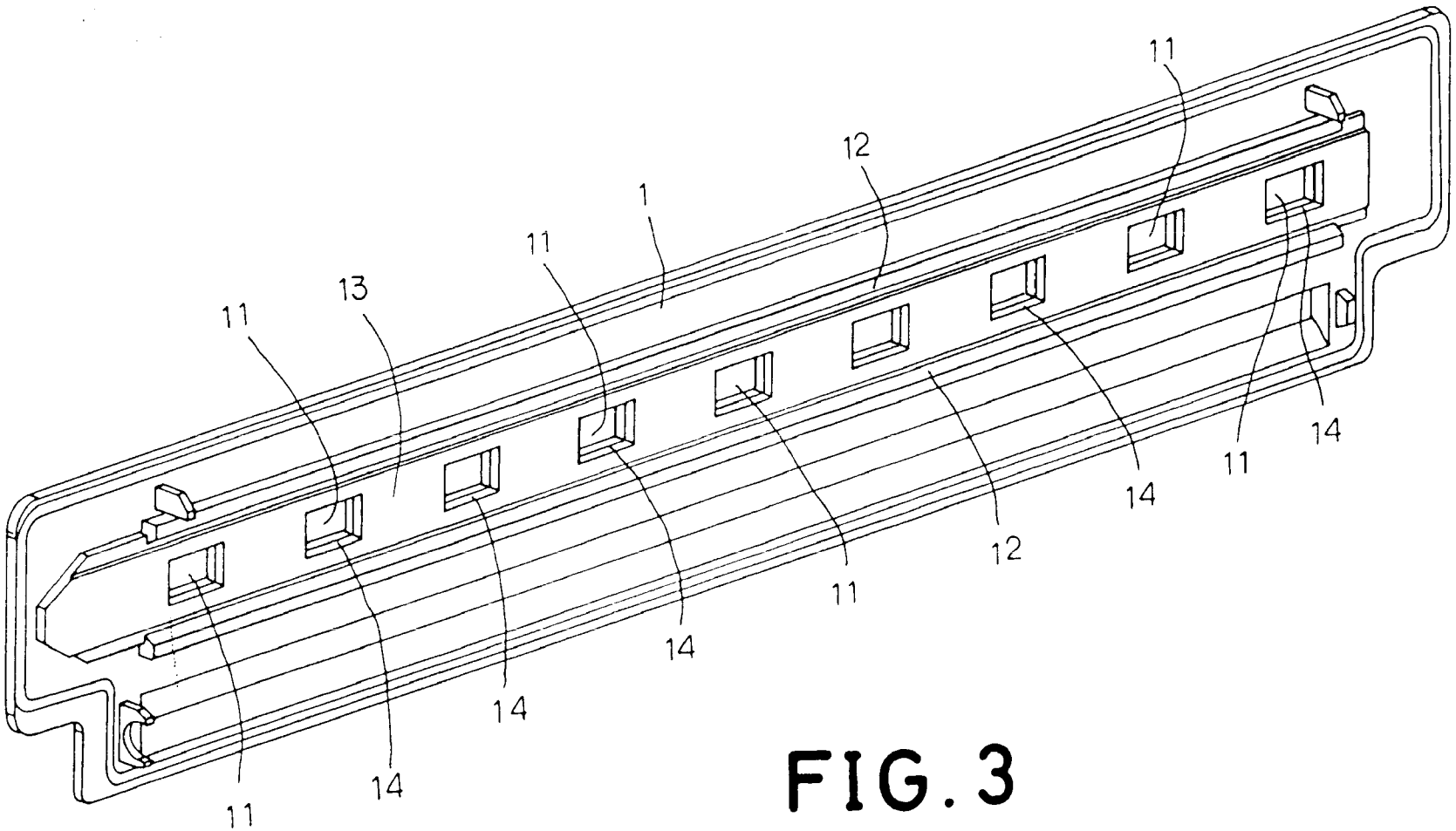
FIG. 3 is a back side view of the developing device, showing the first sliding cover moved to the open position and the toner receiving openings opened according to the first embodiment of the present invention.
Figure 4:
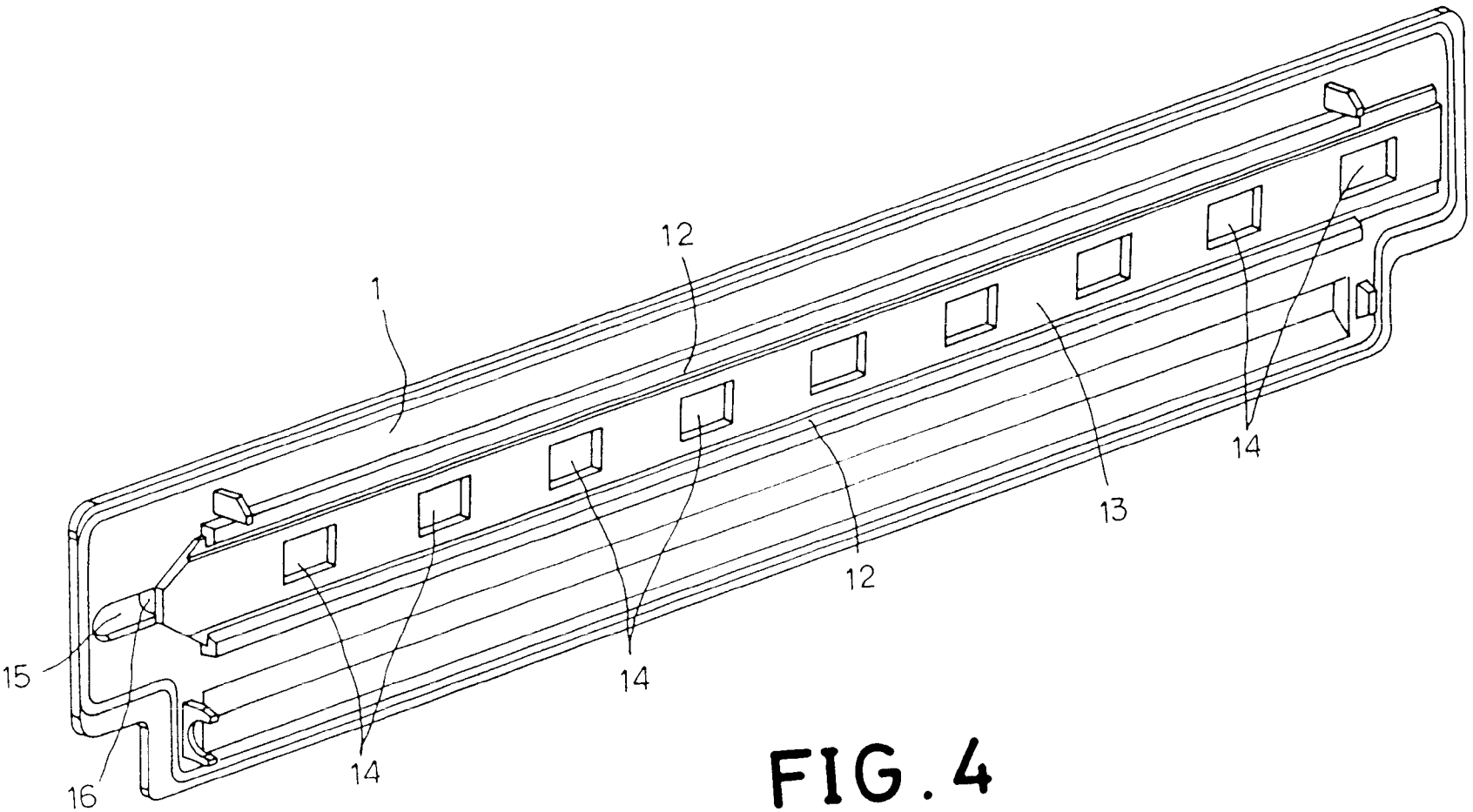
FIG. 4 is similar to FIG. 3 but showing the first sliding cover moved to the close position and the toner receiving openings closed according to the first embodiment of the present invention.

Referring to FIGS. 3 through 4 and FIG. 1 again, the aforesaid blocking member, according to a first embodiment of the present invention, comprises a first sliding cover 13 of the developing device 1, a second sliding cover 23 of the toner container 2, and engagement means. The developing device 1 comprises two elongated guide members 12 arranged in parallel at different elevations above and below the toner receiving openings 11. The first sliding cover 13 is inserted in between the guide members 12 and moved to close/open the toner receiving openings 11 of the developing device 1. The first sliding cover 13 comprises a plurality of openings 14 corresponding to the toner receiving openings 11. The aforesaid engagement means comprise a sliding slot 15 formed on the developing device 1 in line with the toner receiving openings 11 at one side and a projection rod 16 protruded from one end of the first sliding cover 13 and adapted for engaging the sliding slot 15, wherein when the projection rod 16 is positioned within the sliding slot 15, the projection rod 16 is movable between a first predetermined position that is at the end of the sliding slot 15 proximate to the first end 31 of developing device 1 and a second predetermined position that is at the other end of the sliding slot 15 distant from the first end 31 of the developing device 1, and wherein when the projection rod 16 is positioned at the first predetermined position, the first sliding cover 13 closes the plurality of toner receiving openings 11 of the developing device 1, and when the projection rod 16 is moved from the first predetermined position to the second predetermined position, the movement of the projection rod 16 causes the first sliding cover 13 to shift in direction to open the plurality of toner receiving openings 11 of the developing device 1.

Figure 6:
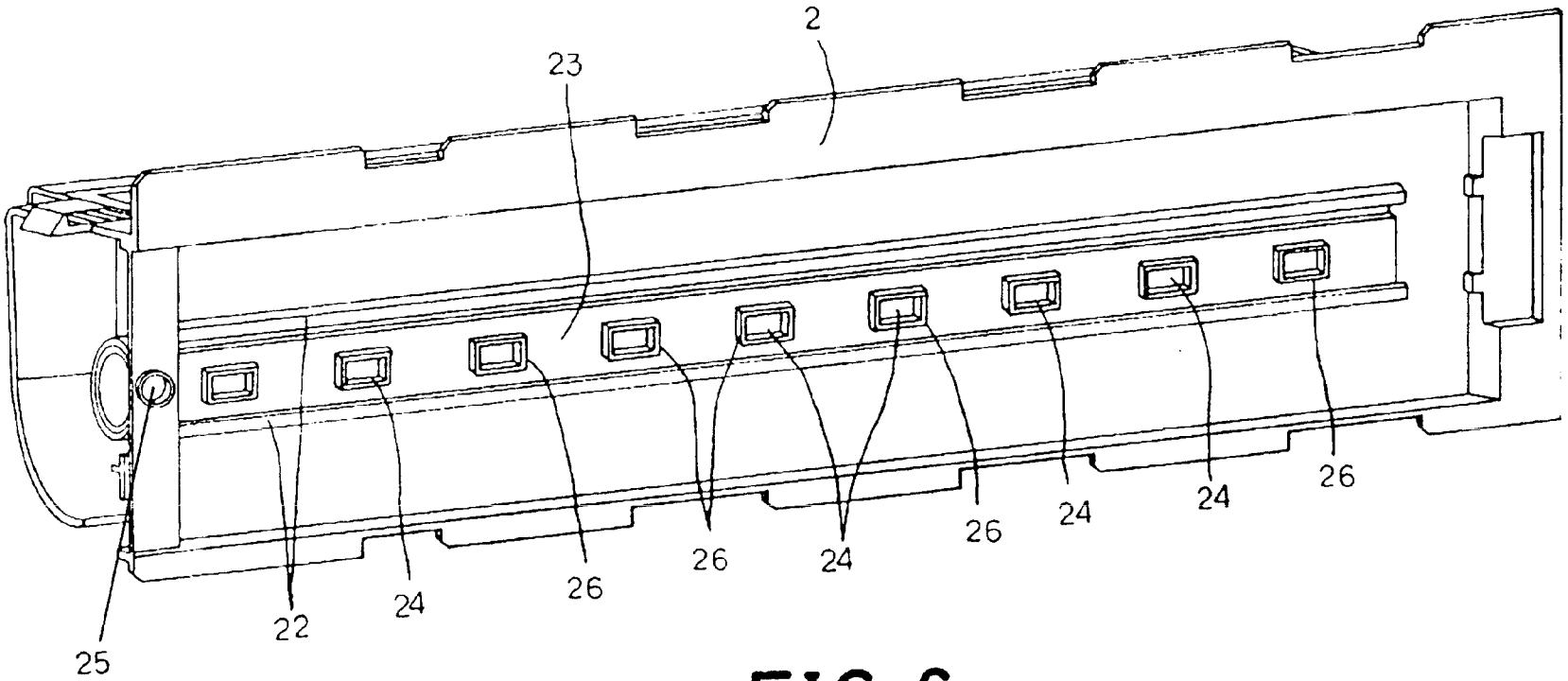
FIG. 6 is similar to FIG. 5 but showing the second sliding cover moved to the close position and the toner supplying openings closed according to the first embodiment of the present invention.

Referring to FIGS. 5 through 6 and FIG. 1 again, the toner containers 2 [further] comprises two elongated guide members 22 arranged in parallel at different elevations above and below the toner supplying openings 21. The second sliding cover 23 is inserted in between the guide members 22 and moved to close/open the toner supplying openings 21. The second sliding cover 23 comprises a plurality of openings 24 corresponding to the toner supplying openings 21. The aforesaid engagement means further comprise a retaining hole 25 formed on the toner container 2 in line with the toner supplying openings 21 and adapted for receiving the projection rod 16 of the developing device 1. The aforesaid engagement means may further comprise a plurality of projections 26 respectively protruded from the second sliding cover 23 around each of the openings 24 and adapted for engaging the toner receiving openings 11 of the developing device 1.

Figure 7:
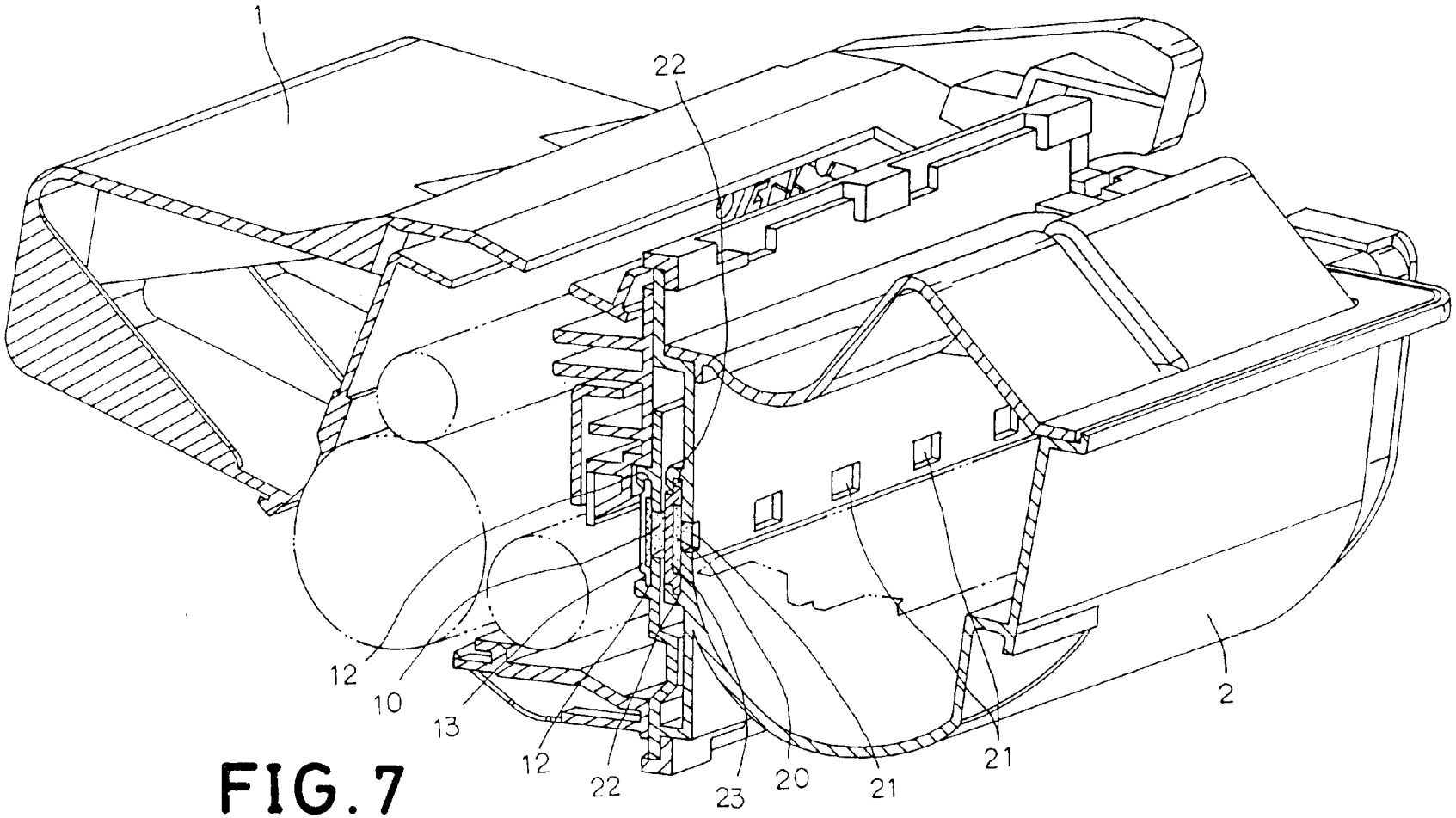
FIG. 7 is a sectional elevation of the first embodiment of the present invention, showing the toner container coupled to the developing device.

Referring to FIG. 7 and FIG. 1 again, when the toner container 2 is to be mounted on the developing device 1 at a predetermined position, the projection rod 16 of the developing device 1 is positioned in the first predetermined position and received in the retaining hole 25 so as to engage with the toner container 2, and the projections 26 are, respectively, engaged into the toner receiving openings 11 of the developing device 1. When the toner container 2 is shifted to be mounted on the developing device 1 at the predetermined position, the shifting movement of the toner container causes the projection rod 16 to move by the engagement between the projection rod 16 and the retaining hole 25 from the first predetermined position to the second predetermined position, and the movement of the projection rod 16 causes the first sliding cover 13 and the second sliding cover 23 to shift in between the respective guide members 12 and 22 in a direction with the toner container 2 to force the plurality of openings 14 into alignment with the toner receiving openings 11, respectively. At this time, the toner supplying openings 21 of the toner container 2 are respectively positioned at the toner receiving openings 11 of the developing device 1 for the passing of toner from the toner container 2 to the developing device 1.

On the contrary, when the toner container 2 is shifted in the reverse direction, for example, to be dismounted from the developing device 1, the shifting movement of the toner container causes the projection rod 16 to move by the engagement between the projection rod 16 and the retaining hole 25 from the second predetermined position to the first predetermined position, and the movement of the projection rod 16 causes the first sliding cover 13 and the second sliding cover 23 to shift in the direction with the toner container 2 to close the toner receiving openings 11 and the toner supplying openings 21, and therefore, the toner passage between the toner container 1 and the developing device 2 is terminated.

Referring to FIG. 7 again, sponge linings 10 and 20 are, respectively, installed in between the developing device 1 and the first sliding cover 13 around the toner receiving openings 11 and in between the toner container 2 and the second sliding cover 23 around the toner supplying openings 21 to prevent leakage of the toner during toner a supplying operation.

Figure 8:
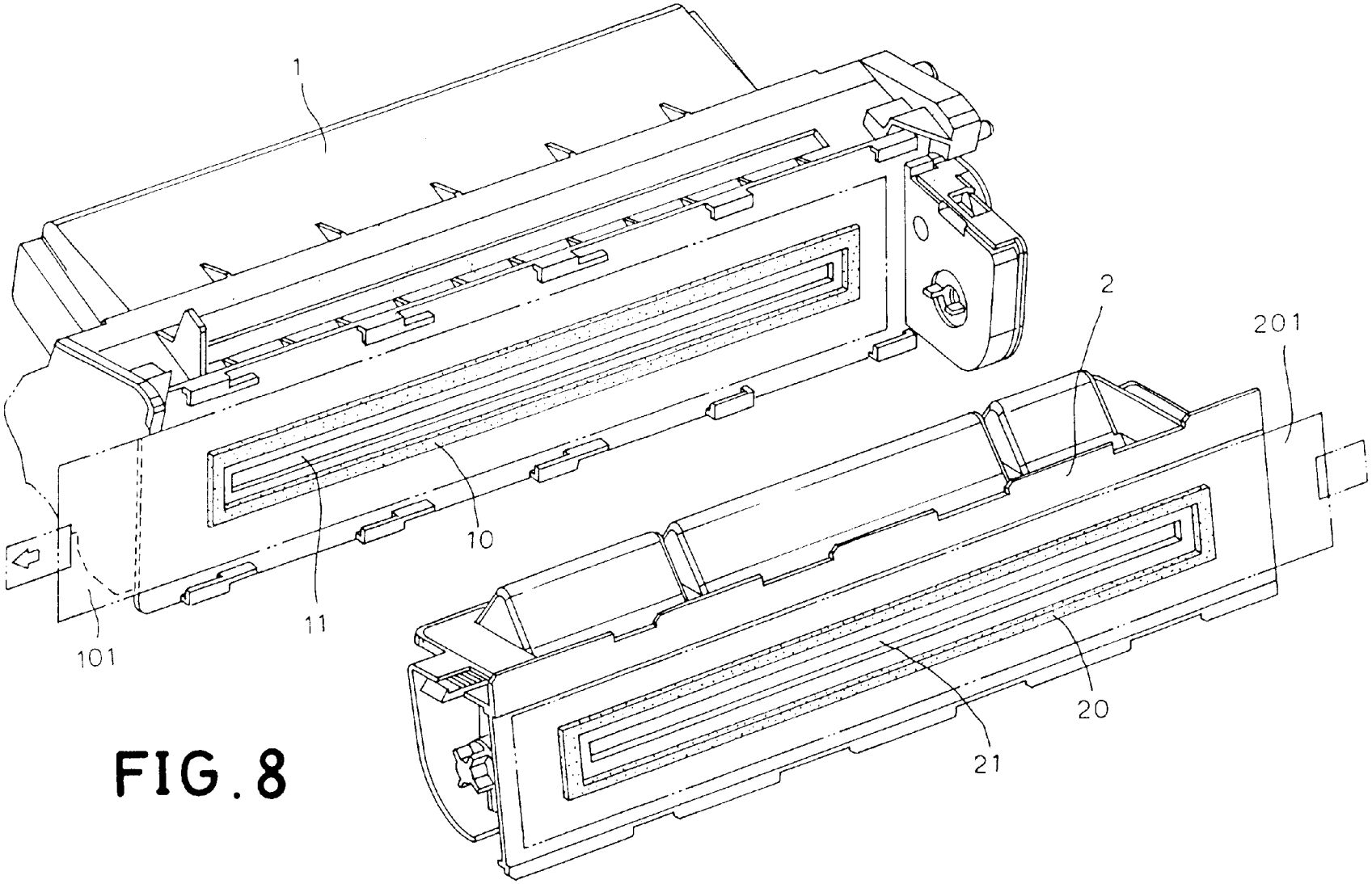
FIG. 8 is an exploded view of the second embodiment of the present invention.

Referring to FIG. 8, the aforesaid blocking member, according to a second embodiment of the present invention, comprises a first strippable strip of sealing film 101 positioned on one side of the developing device 1 to seal the toner receiving openings 11, and a second strippable strip of sealing film 201 positioned on one side of the toner container 2 to seal the toner supplying openings 21. Alternatively, the blocking member can be made having only one strippable strip of sealing film positioned on one side of the developing device 1 (or toner container 2) to seal the toner receiving openings 11 (or supplying openings 21).

Figure 9:
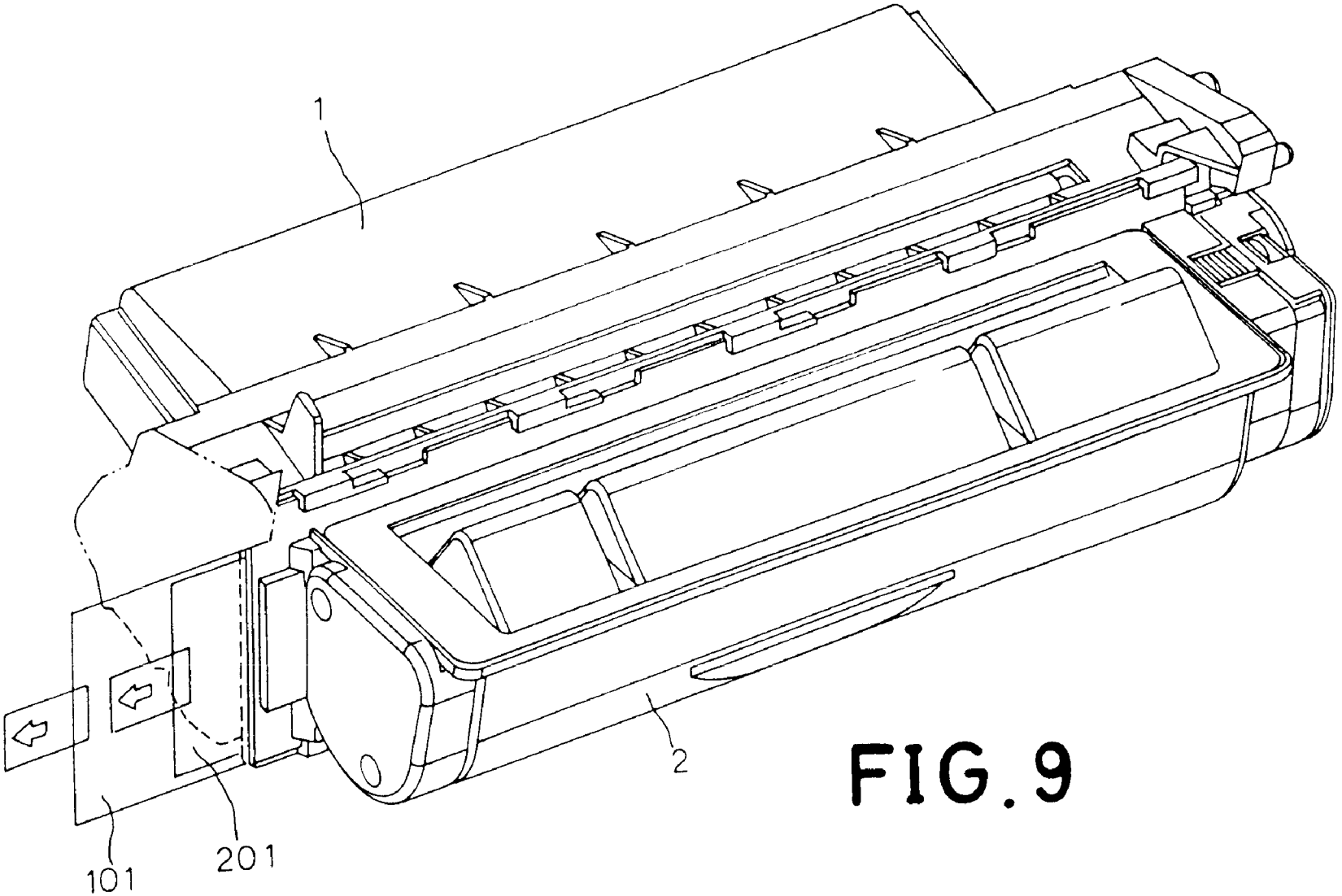
FIG. 9 is an elevational assembly view of the first embodiment of the present invention.

Referring to FIG. 9 and FIG. 8 again, when the toner container 2 and the developing device 1 coupled together, the first strippable strip of sealing film 101 and the second strippable strip of sealing film 201 are pulled outwardly away from the developing device 1 and the toner container 2 respectively, thereby causing the toner passage between the toner receiving openings 11 of the developing device 1 and the toner supplying openings 21 of the toner container 2 to be opened.

A prototype of process cartridge toner supply arrangement has been constructed with the features of FIGS. 1~8. The process cartridge toner supply arrangement functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A process cartridge toner supply arrangement comprising:

a receiving member, said receiving member comprising:

a first end, an opposite second end, and a body defined between the first end and the opposite second end, wherein the body has a plurality of toner receiving openings formed thereon along a longitudinal axis of the body of the receiving member;

a toner accommodating portion adapted for accommodating toner received from said toner receiving openings;

a supplying member, said supplying member comprising: a first end, an opposite second end, and a body defined between the first end and the opposite second end, wherein the body has an interior surface defining a volume for accommodating toner, and wherein the body has a plurality of toner supplying openings formed thereon along a longitudinal axis of the body of the supplying member and adapted for supplying toner from the toner accommodating portion of said supplying member to the toner accommodating portion of said receiving member through said toner supplying openings and said toner receiving openings, wherein the longitudinal axis of the body of the receiving member is in parallel with the longitudinal axis of the body of the supplying member; and a blocking member provided between said receiving member and said supplying member and movable along one of the longitudinal axis of the body of the receiving member and the longitudinal axis of the body of the supplying member to close/open a toner passage between said toner receiving openings and said toner supply openings, wherein said blocking member comprises a first sliding cover coupled to said receiving member and movable along one of the longitudinal axis of the body of the receiving member to close/open said toner receiving openings; a second sliding cover coupled to said supplying member and movable along one of the longitudinal axis of the body of the supplying member to close/open said toner supplying openings; and engagement means provided on said receiving member and said supplying member for enabling said first sliding cover and said second sliding cover to be moved synchronously to simultaneously close/open said toner supplying openings and said toner receiving openings, said engagement means comprising projection means and recess means adapted for receiving said projection means.

2. The process cartridge toner supply arrangement as claimed in claim 1, wherein said projection means of said engagement means comprises a projection rod protruded from said first sliding cover and adapted for engaging said recess means of said engagement means.

3. The process cartridge toner supply arrangement as claimed in claim 1, wherein said recess means of said engagement means comprises a sliding slot formed on said receiving member in line with the plurality of toner receiving openings at one side and adapted for receiving said projection rod of said first sliding cover, wherein when the projection rod is positioned within the sliding slot, the projection rod is movable between a first predetermined position and a second predetermined position, and wherein when the projection rod is positioned at the first predetermined position, the first sliding cover closes the plurality of toner receiving openings of the receiving member, and when the projection rod is moved from the first predetermined position to the second predetermined position, the movement of the projection rod causes the first sliding cover to shift in direction to open the plurality of toner receiving openings of the receiving member.

4. The process cartridge toner supply arrangement as claims in claim 1, wherein said second sliding cover comprises a plurality of openings corresponding to said toner supplying openings.

5. The process cartridge toner supply arrangement as claimed in claim 1, wherein said recess means of said engagement means further comprises a retaining hole disposed on said supplying member in line with said plurality of toner supplying openings at one side and adapted for receiving said projection rod, wherein when the supplying member is to be mounted on the receiving member at a predetermined position, the projection rod is positioned in the first predetermined position and received in the retaining hole so as to engage with the supplying member, wherein when the supplying member is shifted to be mounted on the receiving member at a predetermined position, the shifting movement of the supplying member causes the projection rod to move by engagement between the projection rod and the retaining hole from the first predetermined position to the second predetermined position, and the movement of the projection rod causes the first sliding cover to shift in a direction to be able to open the plurality of toner receiving openings formed on the receiving member.

6. The process cartridge toner supply arrangement as claimed in claim 1, wherein said receiving member comprises two elongated guide members arranged in parallel at different elevations above and below said toner receiving openings and adapted for guiding movement of said first sliding cover to close/open said toner receiving openings.

7. The process cartridge toner supply arrangement as claimed in claim 1, wherein said first sliding cover comprises a plurality of openings corresponding to said toner receiving openings.

8. The process cartridge toner supply arrangement as claimed in claim 1, wherein said supplying member comprises two elongated guide members arranged in parallel at different elevations above and below said toner supplying openings and adapted for guiding movement of said second sliding cover to close/open said toner supplying openings.

9. The process cartridge toner supply arrangement as claimed in claim 1, further comprising a sponge lining fixedly provided between one side of said supplying member and said second sliding cover around said toner supplying openings.

10. A process cartridge toner supply arrangement, comprising:

a receiving member, said receiving member comprising a plurality of toner receiving openings and a toner accommodating portion adapted for accommodating toner received from said toner receiving openings;

a supplying member, said supplying member comprising a toner accommodating portion adapted for accommodating toner and a plurality of toner supplying openings adapted for supplying toner from the toner accommodating portion of said supplying member to the toner accommodating portion of said receiving member through said toner supplying openings and said toner receiving openings; and a blocking member provided between said receiving member and said supplying member and moved to close/open a toner passage between said toner receiving openings and said toner supply openings, wherein said blocking member comprises a first sliding cover coupled to said receiving member and movable relative to said receiving member to close/open said toner receiving openings, a second sliding cover coupled to said supplying member and movable relative to said supplying member to close/open said toner supplying openings, and engagement means provided in said receiving member and said supplying member for enabling said first sliding cover and said second sliding cover to be moved synchronously to simultaneously close/open said toner supplying openings and said toner receiving openings, said engagement means comprising projection means and recess means adapted for receiving said projection means, wherein said projection means of said engagement means comprises a projection rod protruded from said first sliding cover and engaged into said recess means at said supplying member, wherein said receiving member comprises a sliding slot for the passing of said projection rod to the outside of said receiving member to engage said recess means at said supplying member, and wherein said projection means of said engagement means further comprises a plurality of projections respectively protruded from said second sliding cover and adapted for engaging said toner receiving openings.

11. The process cartridge toner supply arrangement as claimed in claim 10, further comprising a sponge lining fixedly provided between one side of said receiving member and said first sliding cover around said toner receiving openings.

12. The process cartridge toner supply arrangement as claimed in claim 10, further comprising a sponge lining fixedly provided between one side of said supplying member and said second sliding cover around said toner supplying openings.

13. The process cartridge toner supply arrangement as claimed in claim 10, further comprising a strippable strip of sealing film positioned on said receiving member to close said toner receiving openings.

14. The process cartridge toner supply arrangement as claimed in claim 10, further comprising a strippable strip of sealing film positioned on said supplying member to close said toner supplying openings.

* * * * *